US012540797B2

(12) United States Patent
Hokenstrom

(10) Patent No.: US 12,540,797 B2
(45) Date of Patent: Feb. 3, 2026

(54) COVERING DEVICE PROVIDING VISUAL AND THERMAL MASKING CHARACTERISTICS

(71) Applicant: Sean Hokenstrom, West End, NC (US)

(72) Inventor: Sean Hokenstrom, West End, NC (US)

( * ) Notice: Subject to any disclaimer, the term of this patent is extended or adjusted under 35 U.S.C. 154(b) by 0 days.

(21) Appl. No.: 18/226,329

(22) Filed: Jul. 26, 2023

(65) Prior Publication Data

US 2025/0035408 A1 Jan. 30, 2025

(51) Int. Cl.
*F41H 3/02* (2006.01)

(52) U.S. Cl.
CPC ..... *F41H 3/02* (2013.01)

(58) Field of Classification Search
CPC ..... F41H 3/00; F41H 3/02
See application file for complete search history.

(56) References Cited

U.S. PATENT DOCUMENTS 4,493,863 A 1/1985 Karisson
4,671,988 A * 6/1987 Dowell ..... F41H 3/00 66/190
6,127,007 A 10/2000 Cox et al.
8,013,776 B2 9/2011 Child
9,276,324 B2 3/2016 Kelsey et al.
9,312,605 B2 4/2016 Siolund
10,156,427 B2 12/2018 Litwin
10,642,121 B2 5/2020 Kwon et al.
10,669,090 B2 6/2020 Conway
10,960,654 B2 3/2021 Morag et al.
11,333,465 B2 5/2022 Howland
2009/0317596 A1* 12/2009 Flavin ..... F41H 3/00 428/172
2012/0213963 A1* 8/2012 Lee ..... D06M 23/18 428/102
2014/0304883 A1* 10/2014 Morag ..... B32B 3/266 156/253

* cited by examiner

*Primary Examiner* — Laura C Powers
(74) *Attorney, Agent, or Firm* — Ashley D. Johnson; Dogwood Patent and Trademark Law

(57) ABSTRACT

The invention is a covering device that acts as both a visual camouflage and as a thermal blocker to cover people and equipment (e.g., vehicles). Specifically, the covering device effectively reduces and/or prevents thermal, infrared, and visual detection of any subject (e.g., person or equipment) positioned under the device. The covering device includes a unique arrangement of apertures that has been surprisingly shown to reduce and diffuse both the heat and visual signature of the subject.

20 Claims, 4 Drawing Sheets

COVERING DEVICE PROVIDING VISUAL AND THERMAL MASKING CHARACTERISTICS

TECHNICAL FIELD

The presently disclosed subject matter is directed to a covering device that includes visual and thermal masking characteristics. In use, the visual and thermal signature associated with a subject (e.g., human and/or equipment) can be reduced or eliminated by the disclosed covering device.

BACKGROUND

Camouflage netting and apparel are commonly used (particularly by military forces) to reduce the possibility of visual detection. For example, ground combat vehicles (such as tanks) are more likely to be first offense targets of fighters. Thus, the combat vehicles must be camouflaged to avoid being distinguished from the surrounding environment. Equipment and people can therefore be made to blend in with their surroundings and be hidden from enemy forces. Traditionally, camouflage fabrics and nettings have been colored and textured to make it difficult to visually distinguish the fabric from its surroundings.

However, conventional versions of camouflage clothing and netting suffer from various defects. For example, due to the large open areas that allow for a wearer's face to be accessed, typical camouflage apparel does not fully shield a wearer when in use. Further, by design, conventional camouflage netting is often snagged and ripped during use due to the number and prominence of the net openings. Netting also deteriorates quickly when used regularly, requiring frequent replacement. In addition, camouflage clothing and netting offer insufficient protection under radar and thermal imaging which can compromise the location of people and equipment. Further, prior art conventional camouflage materials tend to be heavy and do not allow sufficient ventilation or heat exchange to maintain a reasonable level of comfort, and thus are not practical for operational use. Also, even though people and equipment may be camouflaged in a visible light region, there is a risk of being exposed to the enemy by night-time observation equipment that can observe a near-infrared region and a thermal-infrared region.

It would therefore be advantageous to provide a covering device suitable for use by people and equipment that effectively reduces or eliminates both visual and thermal detection.

SUMMARY

The presently disclosed subject matter is directed to a covering device comprising a top face and opposed bottom face with a thickness therebetween. The covering device includes a plurality of apertures in a predetermined pattern that span the thickness of the covering device. Specifically, the pattern is defined by a series of squares, each square having a length and width of about 1 inch, wherein each square is contacted by a square on a left side, right side, upper side, and lower side. Each square comprises an aperture selected from a first aperture, or a second aperture positioned in the approximate center of the square. The first aperture has a diameter of about 0.2-0.3 inches and the second aperture has a diameter of about 0.1-0.15 inches. Each square comprising a first aperture is contacted by adjacent squares on an upper, lower, left, and right side, all of which comprise a second aperture. Each square comprising a second aperture is contacted by adjacent squares on an upper, lower, left, and right side, all of which comprise a first aperture. The covering device is constructed from one or more reflective materials, such that the covering device provides camouflage visually and thermally.

"Visual camouflage" refers to a material that visually adapts to a surrounding environment, such as through similar colors, patterns, and the like. In this way, the material blends into the surrounding environment and there may be difficulty distinguishing the material from the surrounding environment when viewing the material. Thus, visual camouflage hides an object in the visible spectrum (the portion of the electromagnetic spectrum that is visible to the human eye).

"Thermal camouflage" refers to a material that hides a thermal signature and a thermal infrared signature. Thus, the material is not visible using detection methods such as infrared and radar. An infrared signature depends on many factors, including the shape and size of the object, temperature, and emissivity, reflection of external sources (earthshine, sunshine, skyshine) from the object's surface, the background against which it is viewed, and the waveband of the detecting sensor. For example, the infrared signature gives the physical temperature difference between the object of interest and the immediate background if the recorded radiance values had been measured from perfect blackbody sources. Infrared is electromagnetic radiation (EMR) with wavelengths longer than those of visible light and shorter than radio waves. It is therefore invisible to the human eye. IR is generally understood to encompass wavelengths from around 1 millimeter (300 GHz) to the nominal red edge of the visible spectrum, around 700 nanometers (430 THz).

In some embodiments, the top face, bottom face, or both of the covering device comprise camouflage.

In some embodiments, the covering device is configured as apparel, a tarp, or a blanket.

In some embodiments, the reflective materials are selected from one or more of biaxially oriented polyethylene terephthalate, nylon, acrylic, polyethylene, metal foil, polyimide, ultrathin silicon, fabric, or polytetrafluoroethylene (PTFE).

In some embodiments, the reflective materials are formed as a coating to the top or bottom face of the device.

In some embodiments, the coating is selected from aluminum, aluminum alloy, ultra fine oxide particles, silicone oxide, magnesium oxide, silver, platinum, gold, rhodium, palladium, nickel, chromium, titanium dioxide, iron, iron oxide, copper, tin oxide, zinc, indium, gallium, or combinations thereof.

In some embodiments, each second aperture has a diameter of about half the diameter of each first aperture.

In some embodiments, each first aperture is configured in the same size and shape as the remaining first apertures.

In some embodiments, each second aperture is configured in about the same size and shape as the remaining second apertures.

In some embodiments, each aperture is positioned about 0.5-0.9 inches from adjacent apertures.

In some embodiments, the presently disclosed subject matter is directed to a method of concealing the visual and thermal signature of a subject. Specifically, the method comprises fully draping the covering device over a surface area of the subject, whereby a visual signature of the subject is masked, and a thermal signature of the subject is masked.

In some embodiments, the subject is a human, a plurality of humans, an animal, a plurality of animals, or equipment.

In some embodiments, the covering device conceals the visual and thermal signal as long as the device is draped over the surface area of the subject.

BRIEF DESCRIPTION OF THE DRAWINGS

The previous summary and the following detailed descriptions are to be read in view of the drawings, which illustrate some (but not all) embodiments of the presently disclosed subject matter.

DETAILED DESCRIPTION

Figure 1A:
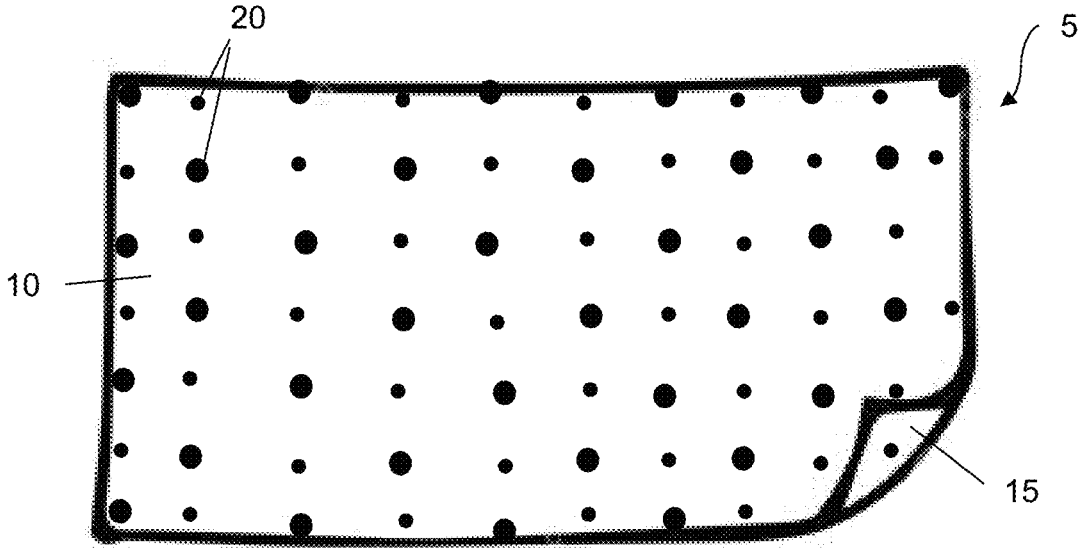
FIG. 1*a* is a top plan view of a visual and thermal blocking device in accordance with some embodiments of the presently disclosed subject matter.

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a device" can include a plurality of such devices, and so forth.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−0.1-20% from the specified amount, as such variations are appropriate in the disclosed packages and methods.

The presently disclosed subject matter is directed to a covering device that acts as both a visual camouflage and as a thermal blocker to cover people and equipment (e.g., vehicles). As discussed in detail below, the covering device effectively reduces and/or prevents thermal, infrared, and visual detection of any subject (e.g., person or equipment) positioned under the device. The covering device includes a unique arrangement of apertures that has been surprisingly shown to reduce and diffuse both the heat and visual signature of the subject. Specifically, the apertures allow a user to see from underneath the covering device, such as in a combat or hostile environment. In addition, the apertures are sized and arranged to prevent the covering device from being detected in the surrounding environment. The apertures further act to diffuse the heat signature and infrared signature from a person/animal or equipment (e.g., a warm vehicle). Thus, the disclosed covering device can be used in a wide range of different ambient conditions to block both the visual and thermal/infrared signature of a subject.

As discussed in detail below, the covering includes a uniform pattern of apertures extending over the entire surface. The apertures are arranged in a repeating pattern of large and small alternating openings. It has been surprisingly found that the particular pattern of apertures provides many advantages over prior art coverings. For example, the pattern of apertures provides ventilation from within the covering and reduces the weight of the device. The pattern further effectively obscures the long wave radiation returned by the covering to thermal and radar imaging devices. As a result, the disclosed covering provides a defense against detection by electro-optic, electromagnetic, thermal, and radar element, in addition to providing visual camouflage for the covered object or objects.

Figure 1B:
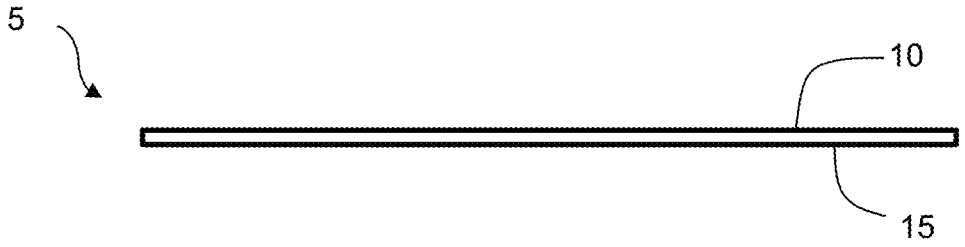
FIG. 1*b* is a cross-sectional view of the device of FIG. 1*a* in accordance with some embodiments of the presently disclosed subject matter.

FIGS. 1*a* and 1*b* illustrate one embodiment of covering device 5 that can be used to effectively reduce or mask both a visual and thermal signature from a subject positioned at least partially under the device. The term "subject" as used herein refers to any object that can be fully or partially positioned under covering device 5, such as (but not limited to) one person, multiple people, vehicles, equipment, and combinations thereof. As shown, the device includes top face 10 and opposed bottom face 15. The top face of the device is the face that extends towards and/or contacts the external environment. The bottom face is the face that extends towards and/or contacts a subject housed under the device. The device includes a plurality of apertures 20 configured in a specific pattern to maximize the ability of a user positioned under the device to see out into the external environment, while also masking the user's thermal signature.

The top and/or bottom faces 10, 15 can include a camouflage design to blend the device into the surrounding environment. The term "camouflage design" refers to a color or shape pattern of an article of clothing or device that contains two or more adjacent colors or shapes for purposes of concealment. Thus, one or both of the top and bottom covering faces can comprise a camouflage pattern. In some embodiments, the same camouflage design is on both the top and bottom faces. In other embodiments, each face has a unique camouflage design, allowing versatility in several environments. As a result, covering device 5 provides visual camouflage for a covered subject using any suitable mechanism (e.g., coloring that approximates the colors of a surrounding environment and/or the inclusion of a textured or rippled surface to mimic the random structure and appearance of a natural environment). Thus, the device can blend in with its surroundings to both a casual observer and an individual conducting a visual search.

Device 5 can take any of a wide variety of forms, such as (but not limited to) a blanket, apparel (e.g., shirt, coveralls, pants, poncho, tunic, combinations thereof) depending on the pattern used for the undergarment), or any type of covering that can be placed fully or partially over one or more people and/or over one or more items of equipment. For example, the device can be configured to fit over a single person or 2 or more people. Similarly, the device can be used to hide a small number of weapons or one or more large vehicles.

To this end, covering device 5 can be configured in any suitable shape, such as (but not limited to) square, rectangular, triangular, trapezoidal, oval, circular, pentagonal, hexagonal, octagonal, abstract, and the like.

Figure 2A:
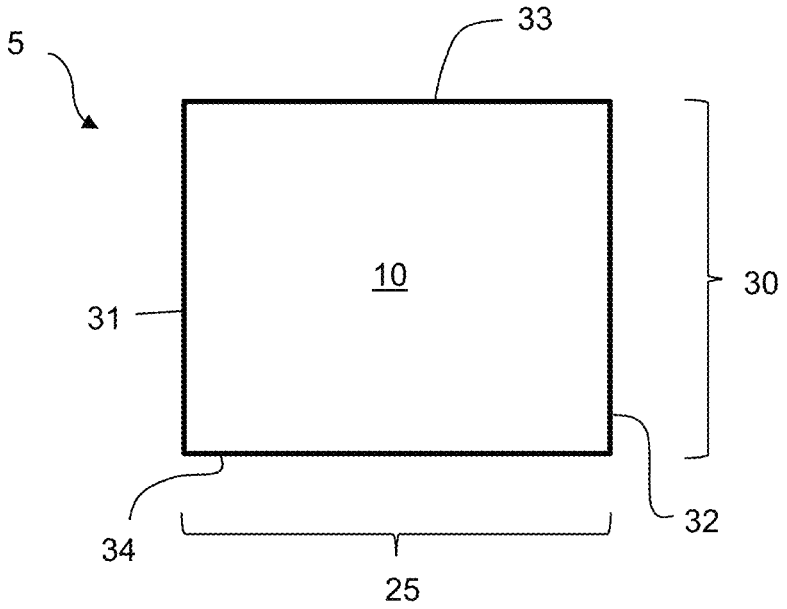
FIG. 2*a* is a top plan view of a visual and thermal blocking device in accordance with some embodiments of the presently disclosed subject matter.
Figure 2B:
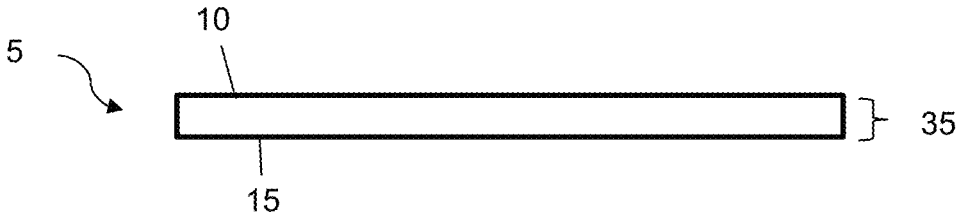
FIG. 2*b* is a cross-sectional view of the device of FIG. 1*a* in accordance with some embodiments of the presently disclosed subject matter.

Device 5 can further be configured with any desired dimensions. For example, as shown in FIGS. 2*a* and 2*b*, the device can have length 25 and/or width 30 of about 3-50 feet (e.g., at least/no more than about 3, 5, 10, 15, 20, 25, 30, 35, 40, 45, or 50 feet). The term "length" refers to the longest horizontal distance from first side end 31 of the device to opposed second end 32. The term "width" refers to the longest vertical distance perpendicular to the length (e.g., the distance between upper and lower edges 33, 34). The device can further include thickness 35 of about 0.1-3 inches (e.g., at least/no more than about 0.1, 0.25, 0.5, 0.75, 1, 1.25, 1.5, 1.75, 2, 2.25, 2.5, 2.75, or 3 inches). The term "thickness" refers to the distance between the top and bottom faces of the device. It should be appreciated that the length, width, and thickness of device 5 is not limited and can be configured outside the ranges given above.

Device 5 can take the form of a blanket, apparel, or any type of covering that is placed partially or fully over a user and/or equipment to visually hide the user and/or equipment. In addition, the heat and infrared signature emitted by the covered item/person is also reduced or masked.

The disclosed covering device can be constructed from any flexible material. The term "flexible" refers to the characteristic of allowing movement. Thus, the material selected can allow the device to be draped over a person, vehicle, and the like. In some embodiments, the covering can be constructed from a single layer of material. In other embodiments, the covering can take the form of a plurality of layers joined together to form a unitary device.

In some embodiments, one or more reflective materials can be used to construct covering device 5. It has been found that reflective materials can help to break up a heat signature (e.g., from a person or equipment housed under the device). The term "reflective" refers to a material that redirects visible light and/or heat away from the material rather than transmitting or absorbing the light and/or heat. Stated another way, the reflective materials provide specular scattering of heat and infrared radiation. Suitable materials can therefore include (but are not limited to) biaxially oriented polyethylene terephthalate (e.g., Mylar®), nylon, acrylic, polyethylene, metal foil, polyimide, ultrathin silicon, Kapton®, Melinex®, polytetrafluoroethylene (PTFE), or combinations thereof. However, it should be appreciated that any flexible and reflective material can be used.

Figure 3A:
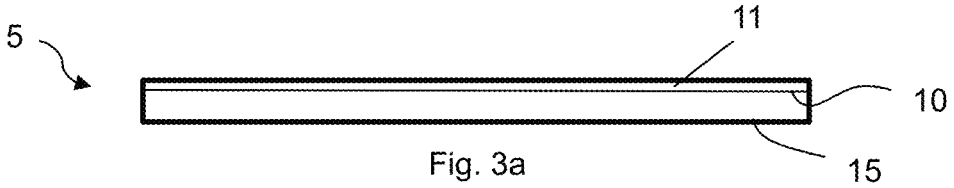
FIGS. 3*a*-3*c* are cross-sectional views of a covering device comprising an outer coating in accordance with some embodiments of the presently disclosed subject matter.
Figure 3B:
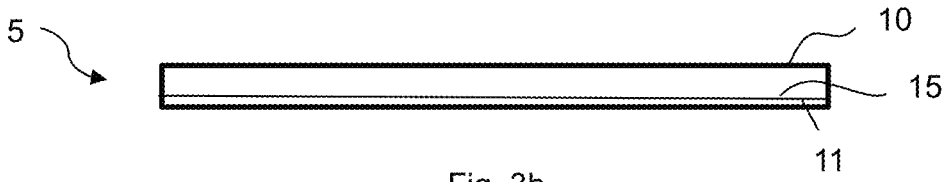
Figure 3C:
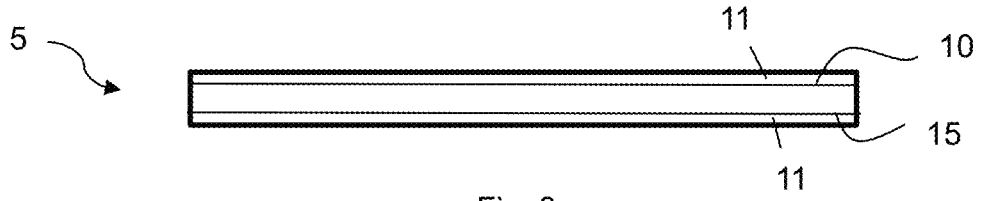

In some embodiments, the covering device can include reflective coating 11 on top and or bottom face 10, 15, as shown in FIGS. 3*a*-3*c*. Suitable reflective coatings can include metallic coatings comprising aluminum, aluminum alloy, ultra fine oxide particles, silicone oxide, magnesium oxide, silver, platinum, gold, rhodium, palladium, nickel, chromium, titanium dioxide, iron, iron oxide, copper, tin oxide, zinc, indium, gallium, or combinations thereof. The coating can have a thickness of about 0.001-0.1 inches in some embodiments. When a coating is used, the covering base layer can be constructed from any suitable material, such as fabric, polymeric material, reflective material, or combinations thereof.

The covering device can optionally include one or more flame retardant components for added safety. Several versions of such flame-retardant coatings or materials are possible.

Figure 4:
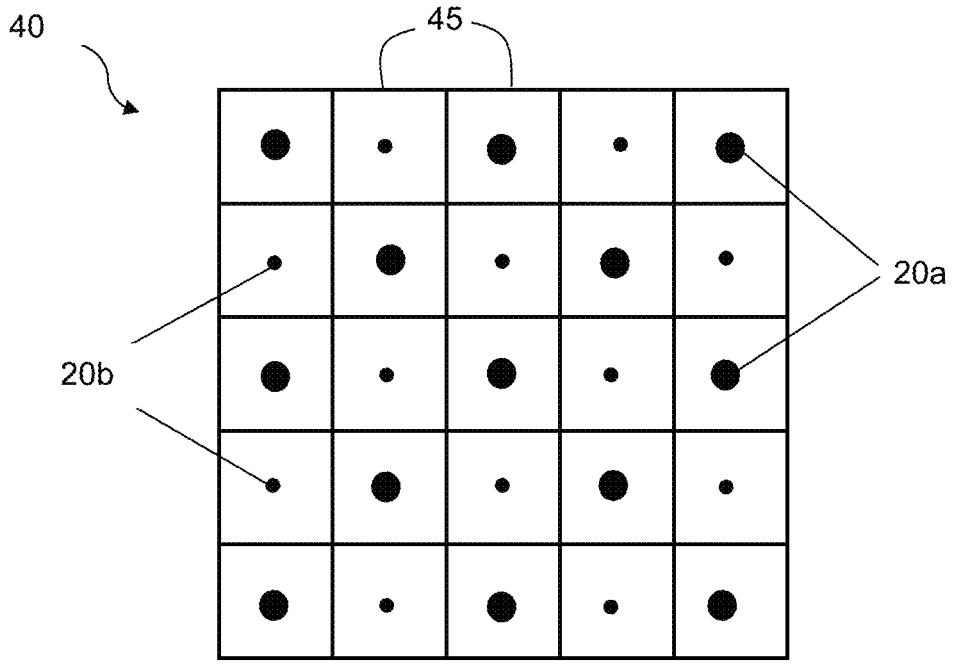
FIG. 4 is a top plan view of a grid pattern present on a covering device in accordance with some embodiments of the presently disclosed subject matter.
Figure 5A:
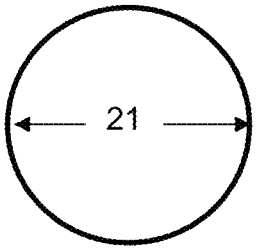
FIGS. 5*a* and 5*b* are top plan view of apertures depicting diameters in accordance with some embodiments of the presently disclosed subject matter.
Figure 5B:
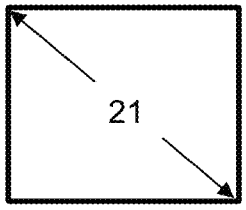

As noted above, the disclosed covering device includes a pattern of apertures 20 that has been surprisingly found to effectively both visually hide an object or person beneath the device and effectively distribute the person or object's heat signature to avoid thermal and/or infrared detection. As illustrated in the representative pattern of FIG. 4, the device is made up of a repeating grid 40 that includes a plurality of first apertures 20*a* surrounded by a plurality of second apertures 20*b*. The term "aperture" refers to an opening that spans the thickness of the covering (e.g., passes through the top and bottom faces of the device). First apertures 20*a* can have a diameter of about 0.2-0.3 inches (e.g., at least/no more than about 0.2, 0.25, or 0.3 inches). Second apertures 20*b* can have a diameter of about 0.1-0.15 inches (e.g., at least/no more than about 0.1, 0.125, 0.15 inches). Thus, in some embodiments, the diameter of the second aperture can be about half that of the diameter of the first aperture (e.g., about 25, 30, 35, 40, 45, 50, 55, 60, 65, 70, or 75 percent as large). Typically, the first and second apertures are positioned about 0.5-0.9 inches apart (e.g., about 0.55, 0.6, 0.65, 0.7, 0.75, 0.8, 0.85, or 0.9 inches) in each direction (e.g., up/down/left/right). The term "diameter" refers to the length of a straight-line segment that passes through the center of a cross-section of an aperture, as shown in FIGS. 5*a* and 5*b* (illustrating diameter 21).

The apertures and noted pattern are important as the openness promotes natural convection of the wearer's body heat through the garment and away from the skin. The apertures also provide increase comfort for the wearer (e.g., less heat build-up and less weight to support).

The grid can include alternating 1-inch squares 45, each square comprising a differently sized opening as the grid moves horizontally and vertically. Thus, each first aperture 20*a* includes a second aperture 20*b* positioned directly above, below, to the right, and to the left. Similarly, each second aperture 20*b* includes a first aperture 20*a* positioned directly above, below, to the right, and to the left. A variety of other dimensions and arrangements for the walls defining the openings can also be relied upon in achieving the desired open area, but the arrangement of FIG. 4 has proven to be well suited for the disclosed visual and thermal masking applications. The apertures can be positioned in the approximate center of each square 45. The size, orientation, and alternating pattern of the apertures are selected to give, inter alia, sufficient ventilation and thermal masking properties while maintaining durability and strength of the covering.

The apertures can be created in any desired shape, such as circles, squares, rectangles, and the like. All of the second apertures 20*b* can be configured in the same or about the same shape. Similarly, all of the first apertures 20*a* can be configured in the same or about the same shape. However, the first and second apertures can be configured in the same or in different shapes (e.g., the second apertures can be squares while the first apertures can be triangles, or all apertures can be the same shape). The openings are cut at regular intervals to visually hide people/equipment placed under the device. The apertures allow a person to see out to the external environment and ensure that any body heat is dissipated as the heat is reflected. In this way, the device blocks visual, infrared, and thermal protection of people/equipment behind the device but also allows a user to see out.

The squares that make up the grid as described above can span the entire structure of the covering device in some embodiments. In other embodiments, the aperture pattern can span about 75-99 percent of the surface area of the covering device (e.g., at least/no more than about 75, 80, 85, 90, 95, or 99 percent).

The apertures can be created using any desired method, such as (but not limited to) the use of a sharp instrument (e.g., scissors), laser cutting, stamping, and the like. The openings pass through the entire thickness of device 5.

The disclosed covering 5 can be used in a variety of temperatures. For example, the device may be usable in temperatures as low as negative 35 degrees Celsius and as high as 70 degrees Celsius without any negative impact on the camouflage or other mechanical properties.

Figure 6A:
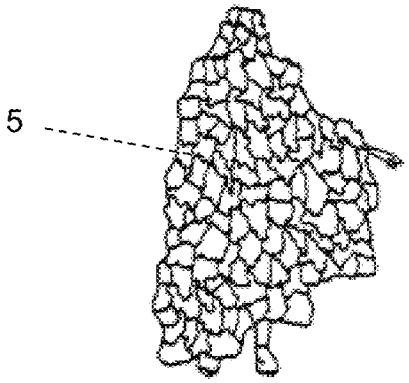
FIG. 6*a* is a perspective view of a covering device positioned over a person in accordance with some embodiments of the presently disclosed subject matter.
Figure 6B:
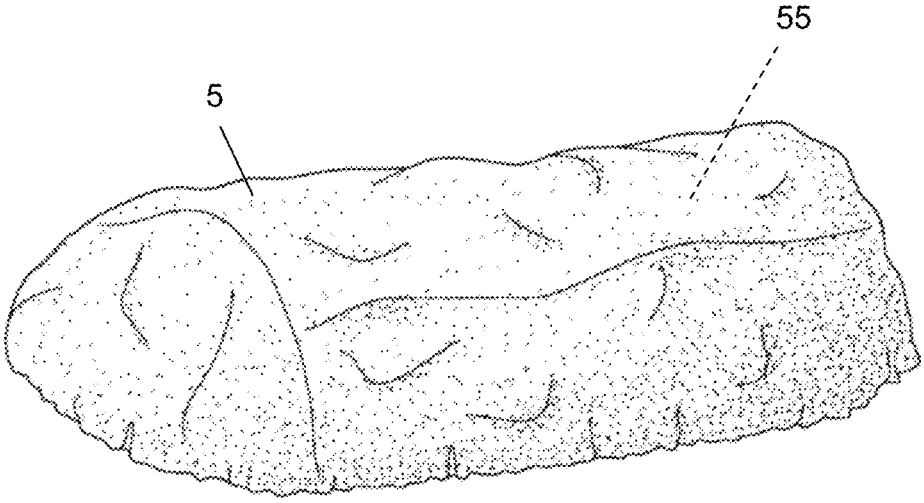
FIG. 6*b* is a perspective view of a covering device positioned over a vehicle in accordance with some embodiments of the presently disclosed subject matter.

In use, the disclosed covering device can be used in any environment in which a subject (e.g., person or equipment) desires not to be seen or otherwise detected. For example, the device can be draped over an object, thereby hiding the object from view. For example, when the object is person 50, device 5 can be draped over the person's head, body, arms, and legs, thereby fully covering them from view, as shown in FIG. 6*a*. In some embodiments, about 100% of the person is housed under the device (e.g., in contact with bottom face 20). In other embodiments, less than 100% of the person is maintained under the device (e.g., about 50-99 percent). Similarly, the device can be draped over all or a portion of equipment (such as tank 55), as shown in FIG. 6*b*.

By reflecting infrared radiation from the environment, the covering device appears to be at approximately the same temperature as its environment and therefore resists detection by thermal imaging devices. Specifically, the heat signature of a person or piece of equipment is masked by the device resulting from the reflective materials that at least partially block a thermal infrared radiation of the subject and blend a background thermal infrared radiation by partial scattering and partial specular reflecting of the subject thermal infrared radiation. The unique pattern of apertures is configured to provide partial ventilation to reduce heat generated by the subject. While not bound by any theory, the combination of large and small apertures visually tricks an observer into not detecting the top side (outward facing side) of the device. The materials used to construct the device and the specific size and spacing of the large and smaller apertures also allow the heat produced by the object to quickly dissipate, avoiding detection. As such a large heat signature cannot be detected using thermal detection and/or infrared detection.

The disclosed covering device provides many advantages over the prior art. For example, the covering is sufficiently light and ventilated to be used in camouflage suits for ambulatory human subjects. The device is also suitable for covering animals, vehicles, boats, aircraft, and stationary objects.

The covering has an outer appearance that can be selected to mimic the ambient environment, providing visual camouflage.

The device can be used in a variety of temperatures.

An additional object of the present invention is to provide a device for thermal and visual camouflage which facilitates automatic thermal and visual adaptation of the surroundings, and which facilitates providing an uneven thermal and visual structure.

The disclosed covering device provides visibility through the device (via the apertures), so that a person under or within the covering can see the outer surroundings without being seen.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A covering device comprising:

a top face and opposed bottom face with a thickness therebetween;

a plurality of apertures in a predetermined uniform, repeating, alternating pattern that span the thickness of the covering device, the covering device being configured as a single planar layer;

wherein the pattern is defined by:

a series of discrete contiguous squares that define a spacing and arrangement of one or more apertures, each square having a length and width of about 1 inch, and wherein each square is configured as an outer square on an outer edge of the covering device or is configured as an inner square positioned within an interior of the covering device, wherein each inner square is contacted by a square on a left side, right side, upper side, and lower side, and wherein each outer square is contacted by a square on two or three of a left side, right side, upper side, or lower side;

wherein each square comprises an aperture selected from a first aperture or a second aperture positioned centrally in the approximate center of the square;

wherein the first aperture has a diameter of about 0.2-0.3 inches;

wherein the second aperture has a diameter of about 0.1-0.15 inches;

wherein each inner square comprising a first aperture is contacted by adjacent squares on an upper, lower, left, and right side, all of which comprise a second aperture; and wherein each inner square comprising a second aperture is contacted by adjacent squares on an upper, lower, left, and right side, all of which comprise a first aperture;

wherein each outer square comprising a first aperture is contacted by adjacent squares on two or three of a left side, right side, upper side, or lower side, where each adjacent square comprises a second aperture; and wherein each outer square comprising a second aperture is contacted by adjacent squares on two or three of a left side, right side, upper side, or lower side where each adjacent square comprises a first aperture;

wherein the alternating first and second apertures collectively form a two-dimensional checkerboard-like lattice that extends across substantially an entire surface of the covering device, providing controlled optical disruption and uniform thermal diffusion; and wherein the covering device is constructed from one or more reflective materials or reflective coatings configured to scatter and reflect infrared radiation, such that the covering device provides camouflage both visually and thermally.

2. The covering device of claim 1, wherein the top face, bottom face, or both comprise camouflage.

3. The covering device of claim 1, configured as apparel, a tarp, or a blanket.

4. The covering device of claim 1, wherein the reflective materials are selected from one or more of biaxially oriented polyethylene terephthalate, nylon, acrylic, polyethylene, metal foil, polyimide, ultrathin silicon, fabric, or polytetrafluoroethylene (PTFE).

5. The covering device of claim 1, wherein the reflective materials are formed as a coating to the top or bottom face of the device.

6. The covering device of claim 5, wherein the coating is selected from aluminum, aluminum alloy, ultra fine oxide particles, silicone oxide, magnesium oxide, silver, platinum, gold, rhodium, palladium, nickel, chromium, titanium dioxide, iron, iron oxide, copper, tin oxide, zinc, indium, gallium, or combinations thereof.

7. The covering device of claim 1, wherein each second aperture has a diameter of about half a diameter of each first aperture.

8. The covering device of claim 1, wherein each first aperture is configured in the same shape as the remaining first apertures.

9. The covering device of claim 1, wherein each second aperture is configured in about the same shape as the remaining second apertures.

10. The covering device of claim 1, wherein each aperture is positioned about 0.5-0.9 inches from adjacent apertures.

11. A method of concealing a visual and thermal signature of a subject, the method comprising:

draping the covering device of claim 1 over a surface area of the subject, whereby a visual signature of the subject is masked; and whereby a thermal signature of the subject is masked.

12. The method of claim 11, wherein the subject is a human, a plurality of humans, an animal, a plurality of animals, or equipment.

13. The method of claim 11, wherein the covering device conceals the visual and thermal signal as long as the device is draped over the surface area of the subject.

14. The method of claim 11, wherein the top face, bottom face, or both comprise camouflage.

15. The method of claim 11, wherein the covering device is configured as apparel, a tarp, or a blanket.

16. The method of claim 11, wherein the reflective materials are selected from one or more of biaxially oriented polyethylene terephthalate, nylon, acrylic, polyethylene, metal foil, polyimide, ultrathin silicon, fabric, or polytetrafluoroethylene (PTFE).

17. The method of claim 11, wherein each second aperture has a diameter of about half a diameter of each first aperture.

18. The method of claim 11, wherein each first aperture is configured in the same size as the remaining first apertures.

19. The method of claim 11, wherein each second aperture is configured in about the same shape as the remaining second apertures.

20. The method of claim 11, wherein each aperture is positioned about 0.5-0.9 inches from adjacent apertures.

* * * * *